United States Patent [19]

Mulcahy

[11] Patent Number: 4,522,249

[45] Date of Patent: Jun. 11, 1985

[54] CONTINUOUS CASTING OF STEEL

[75] Inventor: Joseph A. Mulcahy, Brooklin, Canada

[73] Assignee: J. Mulcahy Enterprises Incorporated, Whitby, Canada

[21] Appl. No.: 538,216

[22] Filed: Oct. 3, 1983

[51] Int. Cl.[3] ..... B22D 27/02

[52] U.S. Cl. ..... 164/466; 164/502; 164/478; 164/416

[58] Field of Search ..... 164/466, 468, 502, 147.1, 164/504, 478, 416, 260, 71.1

[56] References Cited

FOREIGN PATENT DOCUMENTS 56-11165 2/1981 Japan ..... 164/468

604619 4/1978 U.S.S.R. ..... 164/416

*Primary Examiner*—Kuang Y. Lin

*Attorney, Agent, or Firm*—Sim & McBurney

[57] ABSTRACT

In the continuous casting of steel, surface imperfections associated with the use of an oscillating bar for removal of the cast billet from the mold are substantially eliminated by providing a pulsating high intensity magnetic field around the mold to cause flexing of the metal to detach solidified metal from the internal wall of the mold.

15 Claims, 3 Drawing Figures

CONTINUOUS CASTING OF STEEL

FIELD OF INVENTION

The present invention relates to the continuous casting of steel.

BACKGROUND TO THE INVENTION

In the horizontal continuous casting of steel to form steel billets, molten steel is passed horizontally through a cooled mold to cause solidification of the steel. The steel is oscillated back and forth within the mold by the use of an oscillating drive to release cooled solidified steel from the mold wall as it passes through the mold and to remove the cast steel from the mold. The oscillation procedure necessary to remove the cast steel continuously from the mold often leads to surface defects, such as cracks and tears, and to a general surface roughness. These defects do not permit the product to be readily acceptable by a rolling mill.

SUMMARY OF INVENTION

In accordance with the present invention, there is provided an improved method of continuous casting of steel, or other molten metal or alloy, which does not involve the use of longitudinal oscillation and does not result in the formation of surface defects. In the present invention, the mold is constructed of electroconductive material and is surrounded by an electrical coil and molten metal in the mold is subjected to a pulsating magnetic field produced by the passage of a pulsating d.c. current through the coil.

An intense electrical field, lasting typically for approximately 50 microseconds, is produced by each pulse of electricity passing through the coil. The resulting induced eddy currents in the mold interact with the magnetic field of the coil to effect a mutual repulsion between the magnetic field and the mold, causing the mold to flex inwardly slightly and compress the cooling molten metal, so that when the magnetic field decays the cooled solidified metal is released from the mold walls. In this way, the surface imperfections characteristic of the oscillating removal procedure do not form and true continuous flow of metal through the mold can be effected.

Since the cooled steel billets that result from the present invention are substantially free from surface defects, they can readily be accepted by rolling mills for rolling to finished steel.

DESCRIPTION OF PREFERRED EMBODIMENT

Figure 1:
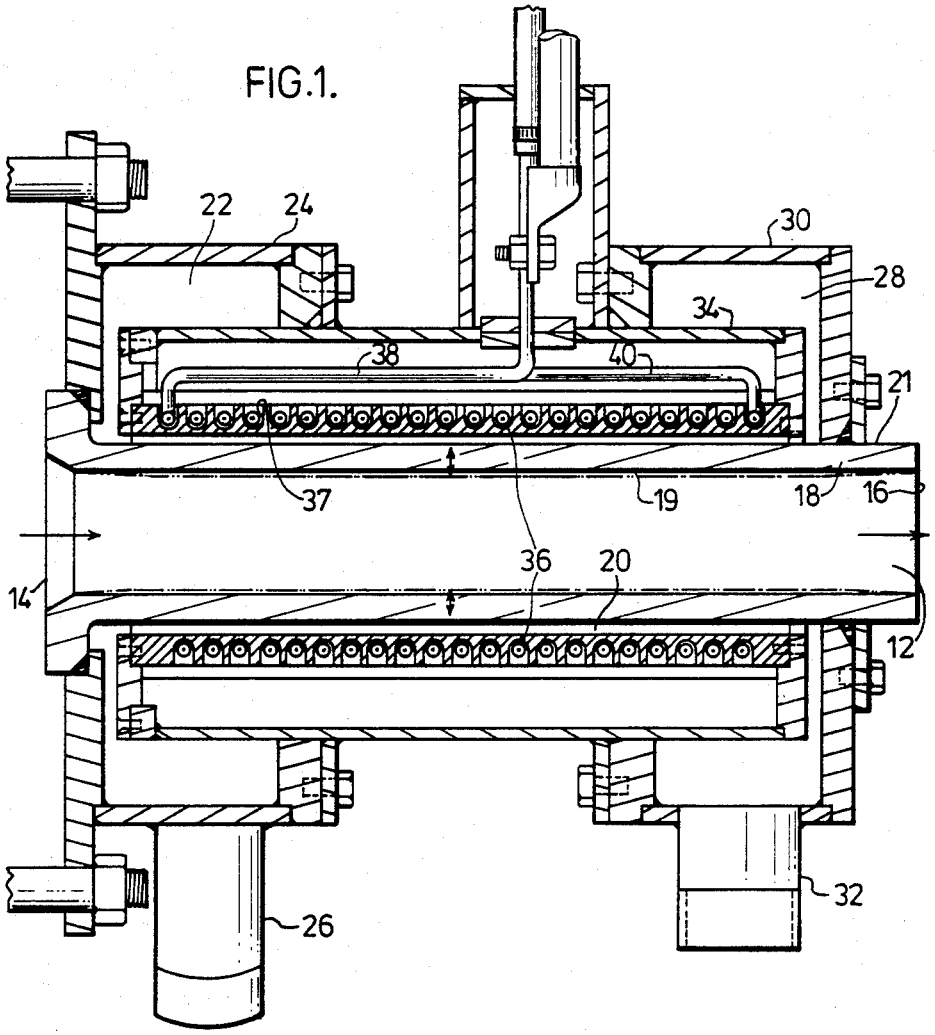
FIG. 1 is an elevational sectional view of a continuous casting mold constructed in accordance with one embodiment of the invention.

Referring to the drawings, a continuous casting mold 10, suitable for the continuous casting of molten steel or other molten metal or alloy, comprises an elongate cavity 12, having an inlet 14 at one end for receiving molten steel to be cast from a tundish (not shown) and an outlet 16 for cooled solidified steel at the other end.

The elongate cavity 12 in the illustrated embodiment is of circular cross section. Other cross-sectional shapes may be used to form steel rods of corresponding shape, such as, a rectangular cross section or a dog-bone cross section. The elongate cavity 12 is provided within a tubular mold member 18 having an inner cylindrical wall 19.

The tubular mold member 18 is constructed of any convenient electroconductive material in which a magnetic field may be induced and which maintains the solid state upon passage of the molten metal therethrough. One suitable material of construction is copper, which may be alloyed with other metals to increase its toughness.

Figure 2:
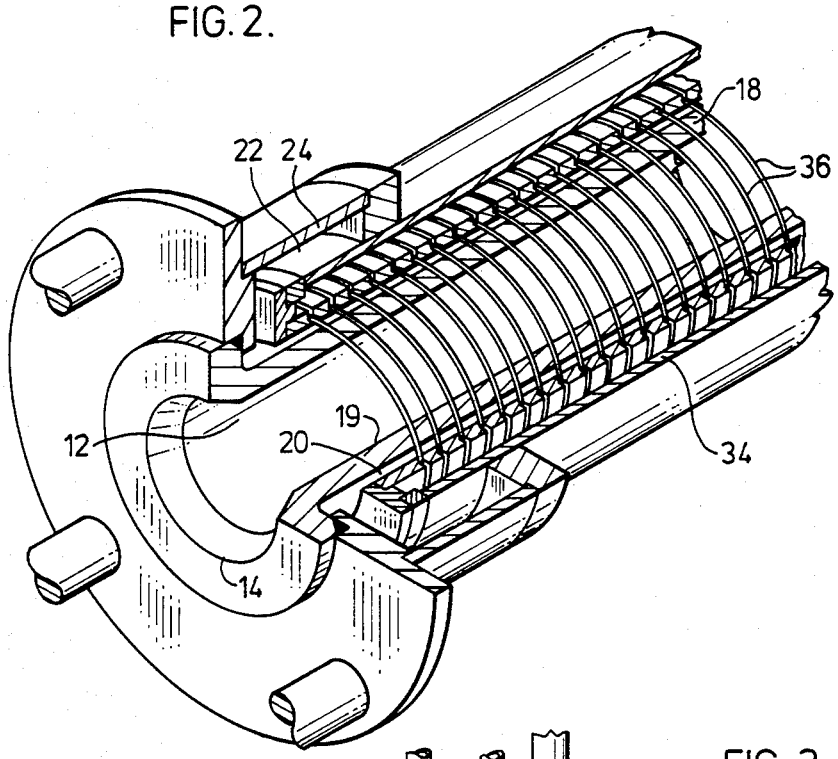
FIG. 2 is a perspective view, with parts cut away for clarity, of the inlet end of the mold of FIG. 1.
Figure 3:
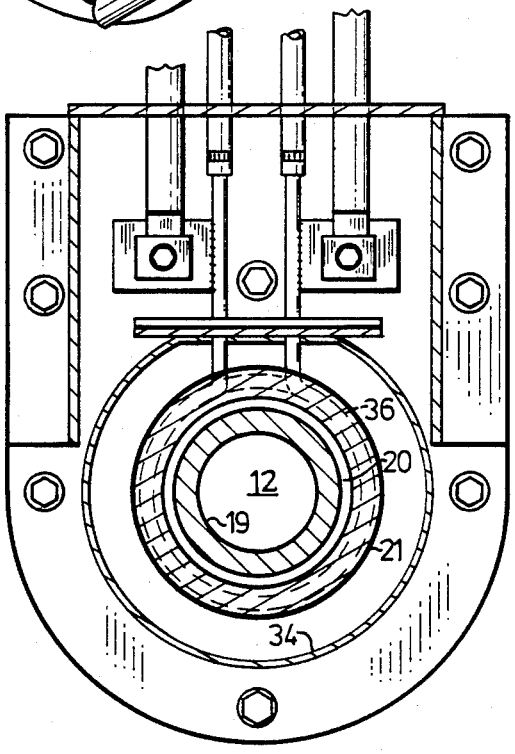
FIG. 3 is an end view of the mold of FIG. 1.

In the illustrated embodiment of FIGS. 1 and 2, the mold 10 is arranged horizontally, so that the molten metal flows through the mold cavity 12 in a horizontal direction. The principles of the invention, as discussed in more detail below, are applicable to any orientation of the mold and direction of molten metal flow, including vertical orientation with upward or downward metal flow and angular orientation with uphill or downhill metal flow.

An annular cooling passage 20 surrounds the outer surface 21 of the tubular mold member 18. Adjacent the inlet end 14 of the mold cavity 12, the upstream end of the cooling passage 20 communicates with a first annular cavity 22 defined by a housing 24 having an inlet passage 26 for the flow of fresh cooling water to the cavity 22 and thence to the cooling passage 20. Adjacent the outlet end 16 of the mold cavity 12, the downstream end of the cooling passage 20 communicates with a second annular cavity 28 defined by a housing 30 having an outlet passage 32 for the flow of used cooling water from the cavity 28. If desired, the cooling water may be caused to flow in the opposite direction through the cooling passage 20 by reversing the flow of water through the passages 26 and 32.

Surrounding and defining the outer wall of the cooling passage 20 is an elongate housing 34 having wire coil windings 36 located in a helical groove 37 therein adjacent the radially inner wall of the housing 34. The housing 34 may be constructed of any convenient electroconductive material in which a magnetic field may be induced, for example, copper. The coil windings 36 are insulated from the helical groove 37 to prevent short circuiting through the housing 34.

The coil windings 36 communicate with electrical power inlet and outlet wires 38 and 40 respectively, which, in turn, are connected to a source of pulsating d.c. power, so as to provide in cyclic manner, short bursts of power through the coil windings, thereby producing a short duration intense magnetic field.

OPERATION

In operation, molten steel, or other molten metal or alloy, is fed to the inlet end 14 of the mold cavity 12. Cooling water is flowed through inlet pipe 26 to the annular cooling passage 20 and thence to the outlet pipe 32. The pressure of molten metal in the tundish causes the molten metal to flow continuously through the casting cavity 12. The cooling passage 20 causes metal closest to the internal wall 19 of the casting cavity 12 to cool and solidify, while the metal remains molten radially inwardly thereof, although ultimately the metal throughout the cross-sectional dimension is solidified and a billet of solid metal is removed from the outlet 16 from the casting cavity 12.

In accordance with the present invention, pulses of short duration d.c. power are applied cyclically to the wire coil 36 to produce an intense magnetic field surrounding the coil 36, at a cyclic rate of generally up to about 1,000 cycles per second. This magnetic field is of very short duration, usually about 10 to about 100 microseconds, and is of high intensity, usually about 5,000 to about 20,000 amps.

The magnetic field produced by the coil windings 36 produces a multifold reaction which results in the cross-sectional dimension of the molten metal contracting during the period of application of the magnetic field. The magnetic field induces eddy currents in the housing 34, the mold chamber 18 and the molten steel. These eddy currents interact with the magnetic field to cause mutual repulsion.

The housing 34 is caused to move slightly radially inwardly, which results in pressure on the cooling water in the passage 20 and thereby onto the mold member 18. This pressure, combined with the effect of mutual repulsion, causes the mold member 18 also to move slightly radially inwardly, thereby applying pressure to the mold metal and contracting the cross-sectional dimension of the molten metal. This contraction is assisted by the mutual repulsion produced by the eddy currents in the steel, but this effect is minor compared to the contraction force produced by the mold member 18.

During the periods between the d.c. pulses, the magnetic field and resulting eddy currents subside or decay, so that the mold member 18 and the housing 34 return to their original position. Since the molten metal has a skin of solid metal resulting from the cooling induced by the passage of cooling water through the passage 20, the metal does not relax to the same extent as the mold member 18 before the next pulse again induces radially inward movement of the mold member 18.

The procedure is repeated as each pulse is applied and the metal flows through the mold cavity 12. As the metal flows through the cavity, more of the cross-section of the metal solidifies, so that the degree of radial flexure of the metal becomes less as the metal progresses downstream in the cavity. Effectively, therefore, the metal is detached from the inner wall of the mold cavity by the rapid reciprocal radial movement of the mold member 18.

The utilization of longitudinally-reciprocating oscillation, as practised in the prior art, therefore, is not required to achieve removal of the continuous casting from the mold cavity 12. The metal flows continuously in a single direction downstream within the mold cavity and is subjected to flexure under the influence of the magnetic field, to permit ready withdrawal from the mold cavity 12 without the formation of significant surface imperfections or blemishes, thereby overcoming the problems of the prior art. The absence of surface defects permits the casting to be forwarded directly to a rolling mill.

SUMMARY OF DISCLOSURE

In summary of this disclosure, the present invention provides an improved method of continuous casting of molten steel which enables surface imperfections to be minimized and throughput to be increased. Modifications are possible within the scope of this invention.

What I claim is:

1. In a method of continuous casting of molten metals by passing the molten metal through a cooled elongate molding zone to effect solidification of the same and removing the solidified metal from the molding zone, the improvement which comprises subjecting said molten metal in said molding zone to a rapidly pulsating high intensity magnetic field to cause inward flexure of said molten metal.

2. The method of claim 1 wherein said molding zone is defined by an elongate tubular mold constructed of electroconductive material, said high intensity magnetic field is applied over at least a substantial length of said mold, and said inwardly flexure of said molten metal is effected by movement of said mold caused by eddy currents induced therein by said high intensity magnetic field.

3. The method of claim 2 wherein said rapidly pulsating magnetic field is formed by passing a pulsating d.c. current through an electrical coil arranged around the elongate tubular mold.

4. The method of claim 3 wherein said magnetic field has a duration of about 10 to about 100 microseconds and an intensity of about 5,000 to about 20,000 amps.

5. The method of claim 4 wherein said magnetic field has a frequency of up to about 1000 cycles per second.

6. The method of claim 1 wherein said molding zone has a circular cross-section and is arranged with its axis extending substantially horizontally, molten metal is fed to one end of said molding zone, flows continuously therethrough, and solidified metal is removed from the other end of the molding zone.

7. The method of claim 6 wherein cooling of said molding zone is achieved by an annular flow of cooling water along the external surface of the molding zone confined within an annular cooling zone and said rapidly pulsating magnetic field is formed by passing a pulsating d.c. current through an electrical coil wrapped about the outer surface of the cooling zone.

8. The method of claim 1 wherein said metal is steel.

9. A molding apparatus suitable for the continuous casting of metals, comprising:

an elongate tubular mold defining a molding cavity therein, having inner and outer walls and having an inlet for molten metal at one end and an outlet for solidified metal in billet form at the other end, said mold being constructed of electroconductive material;

an annular cavity surrounding and spaced from the outer surface of the tubular mold to define an annular flow passage for the passage of cooling water from one end to the other;

first annular housing means enclosing a first cavity communicating with one end of said annular flow passage and also communicating with an inlet for cooliing water;

second annular housing means enclosing a second cavity communicating with the other end of said annular flow passage and also communicating with an outlet for cooling water;

an electrical coil associated with said tubular mold to apply a magnetic field to said mold upon the passage of an electrical current therethrough, and means for applying a pulsating d.c. current to said electrical coil to produce a pulsating high intensity magnetic field which induces movement of said mold to decrease the cross-sectional dimension of said molding cavity.

10. The molding apparatus of claim 9 mounted with said tubular mold arranged substantially horizontally.

11. The molding apparatus of claim 9 wherein said annular cavity comprises an outer wall of electrically condutive material enclosing and defining said flow passage with said outer surface of said mold, said outer wall having a continuous helical groove therein extending from adjacent one end of the wall to adjacent the other end thereof and said electrical coil is formed by a continuous wire located in said helical groove.

12. The molding apparatus of claim 11 wherein said annular cavity extends for a substantial longitudinal length of said tubular mold.

13. The apparatus of claim 9 wherein said tubular mold has a circular cross section.

14. The apparatus of claim 9 wherein said tubular mold has a rectangular cross section.

15. The apparatus of claim 9 wherein said tubular mold has a dog-bone cross section.

* * * * *